US007757808B1

(12) United States Patent
Vaz et al.

(10) Patent No.: US 7,757,808 B1
(45) Date of Patent: Jul. 20, 2010

(54) NOISE REDUCTION SYSTEM

(75) Inventors: Nuno Artur Vaz, West Bloomfield, MI (US); Shung H. Sung, Troy, MI (US); Alan L. Browne, Grosse Pointe, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/365,292

(22) Filed: Feb. 4, 2009

(51) Int. Cl.
*F01N 1/02* (2006.01)
*F02M 35/12* (2006.01)
*F01N 1/00* (2006.01)
*F02M 35/10* (2006.01)

(52) U.S. Cl. ..... 181/250; 181/241; 123/184.57

(58) Field of Classification Search ..... 181/250, 181/241, 266, 271, 273, 276, 277, 278; 123/184.53, 123/184.55, 184.57, 184.56; 60/322, 312
See application file for complete search history.

(56) References Cited

U.S. PATENT DOCUMENTS 2,297,046 A * 9/1942 Bourne ..... 181/250
4,669,842 A * 6/1987 Yomoda et al. ..... 353/101
5,129,279 A * 7/1992 Rennex ..... 74/490.05
5,370,340 A * 12/1994 Pla ..... 244/1 N
5,598,479 A * 1/1997 Dodt et al. ..... 381/71.7
6,405,533 B1 * 6/2002 Rastegar et al. ..... 60/545
6,508,331 B1 * 1/2003 Stuart ..... 181/250
6,581,722 B2 * 6/2003 Faulhaber et al. ..... 181/250
6,634,457 B2 * 10/2003 Paschereit et al. ..... 181/229
6,698,390 B1 * 3/2004 Kostun et al. ..... 123/184.57
6,732,509 B2 * 5/2004 Shiga ..... 60/312
6,792,907 B1 * 9/2004 Kostun et al. ..... 123/184.57
7,093,343 B2 * 8/2006 Osborn ..... 29/594
7,337,877 B2 * 3/2008 Goenka et al. ..... 181/250
7,464,790 B2 * 12/2008 Kodama et al. ..... 181/295
2005/0194207 A1 * 9/2005 Nemit et al. ..... 181/250
2005/0201567 A1 * 9/2005 Browne et al. ..... 381/71.5
2007/0169991 A1 * 7/2007 Bertsch ..... 181/290
2008/0034749 A1 * 2/2008 Ukpai et al. ..... 60/527
2008/0034750 A1 * 2/2008 Gao et al. ..... 60/527
2008/0142294 A1 * 6/2008 Cheng et al. ..... 181/206
2009/0043288 A1 * 2/2009 Petrakis ..... 604/890.1
2009/0165740 A1 * 7/2009 Kubo ..... 123/184.55
2009/0165741 A1 * 7/2009 Kubo et al. ..... 123/184.55

* cited by examiner

*Primary Examiner*—Edgardo San Martin
(74) *Attorney, Agent, or Firm*—Cantor Colburn LLP

(57) ABSTRACT

A noise reduction system for a device having a noise generating subsystem includes a Helmholtz resonator and a controller. The Helmholtz resonator is disposed in fluid communication with the noise generating subsystem, and includes an active material responsive to a control signal that adjusts a dimensional characteristic of the Helmholtz resonator in such a manner as to affect a resonance characteristic of the Helmholtz resonator. The controller is responsive to an operational characteristic of either the device or the noise generating subsystem to produce the control signal. In response to the operational characteristic, the control signal serves to affect the resonance characteristic of the Helmholtz resonator in such a manner as to reduce a noise arising from the noise generating subsystem, or create a desirable sound quality alteration.

19 Claims, 3 Drawing Sheets

NOISE REDUCTION SYSTEM

FIELD OF INVENTION

The present disclosure relates generally to a noise reduction system, and particularly to a noise reduction system for a vehicle utilizing a tunable Helmholtz resonator.

BACKGROUND OF THE INVENTION

Automobiles in general include subsystems that produce undesirable noise, such as but not limited to air induction systems associated with an internal combustion engine. To attenuate the noise wave generated in an intake air duct of an engine, Helmholtz type resonators have been used that change the volume of the resonator to adjust for varying frequencies of the noise wave as engine speed changes. Such designs, however, either bulky-type side chambers or heavy-type piston-type members coupled to an actuator, which can be also bulky arrangements involving multiple interconnected parts that are susceptible to mechanical wear. In addition, such designs being bulky may not fit the space available for packaging them in an automobile without significant design changes.

In view of the above, it is apparent that there exists a need for an improved Helmholtz type resonator having broader flexibility and improved reliability to attenuate various noise frequencies produced by one of various sources of noise associated with the operation of an automobile, or in any application in which a Helmholtz resonator might be used, especially in those in which the noise frequency is varying with operating RPM or speeds.

BRIEF DESCRIPTION OF THE INVENTION

An embodiment of the invention includes a noise reduction system for a device having a noise generating subsystem. The noise reduction system includes a Helmholtz resonator and a controller. The Helmholtz resonator is disposed in fluid communication with the noise generating subsystem, and includes an active material responsive to a control signal that adjusts a dimensional characteristic of the Helmholtz resonator in such a manner as to affect a resonance characteristic of the Helmholtz resonator. The controller is responsive to an operational characteristic of either the device or the noise generating subsystem to produce the control signal. In response to the operational characteristic, the control signal serves to affect the resonance characteristic of the Helmholtz resonator in such a manner as to reduce a noise arising from the noise generating subsystem, or create a desirable sound quality alteration.

Another embodiment of the invention includes a method for reducing noise in a device comprising a noise generating subsystem. In response to an operational characteristic of either the device or the noise generating subsystem, a control signal is generated and sent to a Helmholtz resonator disposed in fluid communication with the noise generating subsystem, where the Helmholtz resonator includes an active material responsive to the control signal by adjusting a dimensional characteristic of the Helmholtz resonator in such a manner as to affect a resonance characteristic of the Helmholtz resonator. In response to the operational characteristic, the control signal serves to affect the resonance characteristic of the Helmholtz resonator in such a manner as to reduce noise level arising from the noise generating subsystem.

BRIEF DESCRIPTION OF THE DRAWINGS

Referring now to the drawings, which are meant to be exemplary and not limiting and wherein like elements are numbered alike in the accompanying Figures.

DETAILED DESCRIPTION OF THE INVENTION

Figure 1:
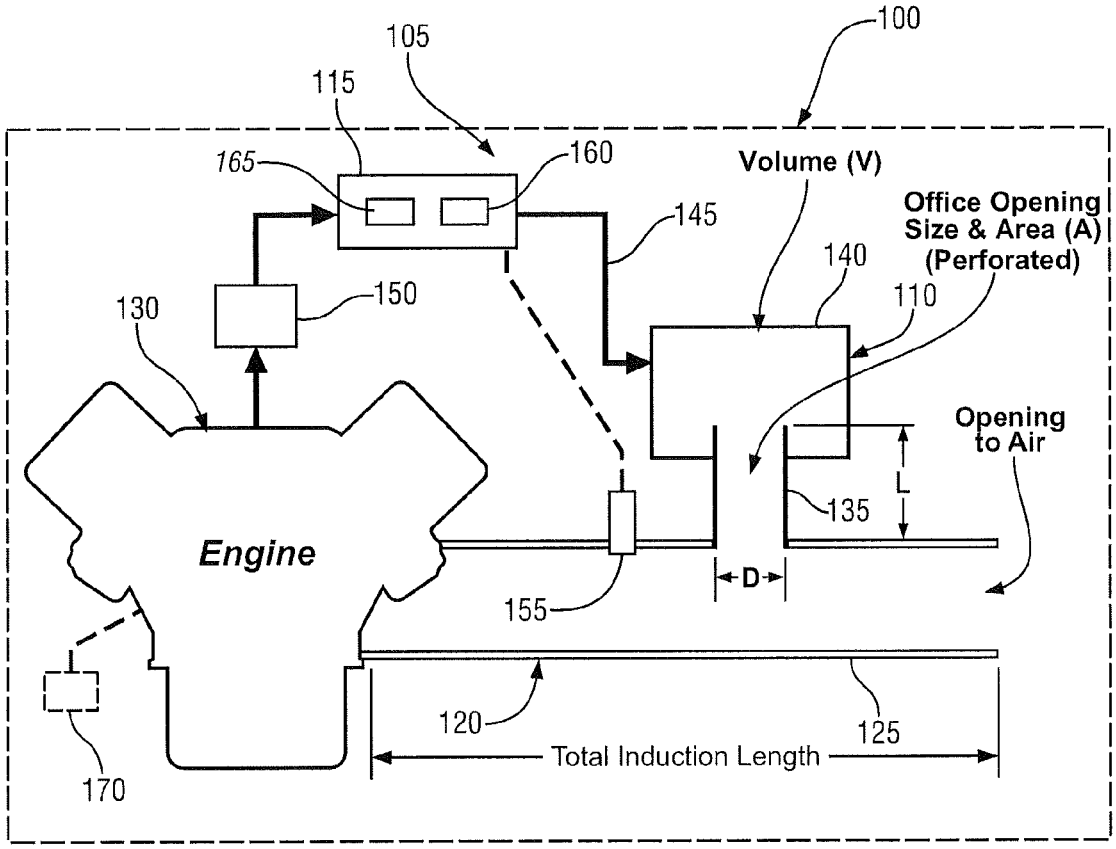
FIG. 1 depicts in block diagram schematic form an exemplary system for reducing noise in a vehicle in accordance with an embodiment of the invention.

An embodiment of the invention, as shown and described by the various figures and accompanying text, provides a noise reduction system for a vehicle that utilizes a tunable Helmholtz resonator made at least partially of an active material responsive to a control signal for changing a dimensional and resonance characteristic of the Helmholtz resonator. The Helmholtz resonator is disposed in fluid communication with a noise generating subsystem of the vehicle, wherein in response to an operational characteristic of the noise generating subsystem in a vehicle, the control signal reversibly tunes the Helmholtz resonator to a desired frequency thereby damping inherent effects of noise level at the harmonic frequencies produced by the noise generating subsystem. As the primary frequency of the noise may change, the resonator can be easily and rapidly tuned to reduce the noise level at the primary frequency.

Alternative embodiments of the invention are directed to the use of smart materials to provide versatile tuning capabilities on Helmholtz resonators in general, and more particularly to the use of smart materials in an automobile for situations in which minimum weight and package space are desired and where adaptability to different engine sizes running at various rpm operating conditions is sought.

Embodiments of the invention also encompass other ways in which active material approaches based on field activated shape memory (both thermal and stress), modulus, and shear strength changes, can be used to control characteristics disclosed herein to achieve the functionality disclosed herein. The use of active materials may also provide benefits in terms of reduced mass, reduced cost, reduced packaging volume, reduced device complexity and parts count, silent operation, reversible operation, and increased robustness for various engine RPM operating conditions as compared to traditional means such as fixed Helmholtz resonator designs, motors, solenoids, electromagnets, and electromechanical actuators in general.

Embodiments disclosed herein provide in general enhancements for Helmholtz resonators that address the problem of reducing induction noise in any motor-driven duct flow application, such as in reducing HVAC (Heating, Ventilation, Air Conditioning) duct noise at various fan operating speeds. While embodiments disclosed herein hold for Helmholtz resonators as a class, in terms of automotive use other applications include a means of balancing both high performance and fuel economy in engines.

Other embodiments contemplated by the inventors, and thus considered within the scope of the invention disclosed herein, include: (a) morphable, movable, or stiffness-alterable "internal flaps" as a means to adjust internal volumes, vibration modes, and noise transmission characteristics in general; (b) using such controllable response Helmholtz resonators to modify acoustic propagation characteristics of noise sources besides engine noise, such as vehicle noise from wind-induced excitations and HVAC excitations; and (c) allowing for electronic override control of the Helmholtz resonator characteristics by the driver and/or passengers in order to tune its characteristics to their individual preferences in the midst of various vehicle operating conditions.

Referring now to FIG. 1, a vehicle 100 is disclosed having a noise reduction system 105, which in an embodiment includes a tunable Helmholtz resonator 110 and a controller 115. The vehicle 100 includes a noise generating subsystem 120, such as an air intake duct 125 in fluid communication with the engine 130. Another noise generating subsystem of the vehicle 100 may include an air conditioning subsystem (comparable to reference numeral 120) having a blower (comparable to reference numeral 130) and an air duct (comparable to reference numeral 125).

An example Helmholtz resonator 110 has a neck 135 that opens into a resonance volume 140. The neck has an overall length (L) and an orifice opening area (A) and an orifice opening size, such as diameter (D), and the resonance volume defines a volume (V). The orifice opening of an example Helmholtz resonator 110 may be singular, or composed of a perforated form. The Helmholtz resonator 110 has a resonance frequency (f) defined by the equation:

$$f = \frac{c}{2\pi}\sqrt{A/(V \cdot L)} \qquad \text{(Eq. 1)}$$

where c is the speed of sound.

In an embodiment, at least a portion of the Helmholtz resonator 110 that defines the length (L), orifice opening area (A), the orifice opening size (D), or volume (V), is made of an active material, such as but not limited to a shape memory alloy, a shape memory polymer, a ferromagnetic shape memory alloy, a magnetorheological elastomer, a magnetostrictive material, an electrostrictive material, a piezoelectric material, piezoceramic material, an electroactive polymer (dielectric elastomer), a magnetorheological fluid, or an electrorheological fluid, which will be discussed in more detail below. However, other classes of embodiments include those in which active materials can be either directly or indirectly (remotely) physically connected/linked to the walls defining the various elements L, A, D, and V of the Helmholtz resonator 110, activation of the active materials causing movements, that is, displacements and deformations, of these walls thus causing a change in at least one of L, A, D, and V. Embodiments in which active materials are used both as elements of the resonator and as directly or indirectly attached actuators are also herein contemplated. In an example Helmholtz resonator, the orifice opening size, diameter (D) for example, controls acoustic impedance, the orifice opening area (A) controls the volume flow, the neck and extended neck length (L) controls the effective acoustic flow rate, and combined with all the above, the total volume (V) controls the detuned harmonic frequency and thus the acoustic pressure reduction incurred at the duct where the Helmholtz resonator is coupled. While embodiments described herein are discussed and illustrated with certain dimensional designs and characteristics, it will be appreciated that other types of shapes and designs may also be employed and still fall within the ambit of the invention disclosed herein.

The Helmholtz resonator 110 is disposed in fluid communication with the noise generating subsystem 120 by way of neck 135 opening into and engaging with air intake duct 125, and is responsive to a control signal 145 from controller 115 that adjusts a dimensional characteristic of the Helmholtz resonator in such a manner as to affect a resonance characteristic in accordance with Equa-1. Controller 115 is responsive to an operational characteristic of either the vehicle 100 or the noise generating subsystem 120 to produce the control signal 145. For example, a first embodiment employs a controller 115 responsive to an operational characteristic of the vehicle 100, such as the speed of the engine 130 in revolutions per minute (rpm), via an engine control module (ECM) 150 that includes information associated with the speed of the engine 130, and a second embodiment employs a controller 115 responsive to an operational characteristic of the noise generating subsystem 120, such as the air pressure in the air intake duct 125, via a pressure sensor 155. In an embodiment, the pressure sensor 155 is a piezoelectric transducer. The signal communication line between pressure sensor 155 and controller 115 is depicted in dashed line fashion in FIG. 1 to illustrate that pressure sensor 155 can be an alternative signal generator to ECM 150. In response to either of the above-mentioned operational characteristics, the control signal 145 serves to change the resonance characteristic of the Helmholtz resonator 110 in such a manner as to reduce a noise arising from the noise generating subsystem 120. That is, the control signal 145 serves to tune the Helmholtz resonator 110 to a resonance frequency (f) by changing at least one dimensional characteristic (L), (A) or (V) in accordance with Equa-1, thereby damping inherent effects of noise level at the harmonic frequencies produced by the noise generating subsystem 120.

In an embodiment where the noise generating subsystem of the vehicle 100 is an air conditioning subsystem, the operational characteristic is the speed of the blower, and the Helmholtz resonator is disposed in fluid communication with an air duct of the air conditioning subsystem.

In an embodiment, the controller 115 includes a processing circuit 160 responsive to computer executable instructions which when executed on the processing circuit 160 facilitates producing the control signal 145 in response to the operational characteristic, engine rpm for example, to change the resonance characteristic of the Helmholtz resonator 110 in such a manner as to reduce the noise propagating energy through the air intake duct 125 arising from the noise generating subsystem 120. In an embodiment, the controller 115 includes an electronic map or lookup table in a memory 165 that defines an operational voltage of the control signal as a function of the speed of the engine. More specifically, the electronic map or lookup table defines a tuning frequency (f) of the Helmholtz resonator 110 as a function of the speed of the engine 130, defines one or more combinations of desired dimensions (L), (A) and/or (V) of the Helmholtz resonator 110 as a function of the tuning frequency (f) in accordance with Equa-1, and defines an operational voltage of the control signal 145 that is productive of the desired dimensional change that will tune the Helmholtz resonator 110 to the defined tuning frequency (f). The data points stored within the electronic map or lookup table are all predefined based on experimental data of a particular piezo-electric/active system. No additional sensor is needed and no power lines are needed to activate the sensor.

In accordance with the aforementioned embodiment, the processing circuit 160 is further responsive to computer executable instructions which when executed on the processing circuit 160 facilitates: defining a tuning frequency of the Helmholtz resonator 110 as a function of the speed of the engine 130; defining a desired dimension of at least a portion of the Helmholtz resonator 110 capable of being changed by application of the control signal 145 to the active material, the desired dimension being a function of the tuning frequency (f); and defining the voltage of the control signal 145 as a function of the desired dimension to produce the desired dimensional change in (L), (A) and/or (V).

In accordance with the aforementioned structure, an embodiment of the invention also includes a method for reducing noise in a vehicle 100 having a noise generating subsystem 120. The method includes: in response to an operational characteristic of either the vehicle 100 or the noise generating subsystem 120, generating and sending a control signal 145 to a Helmholtz resonator 110 disposed in fluid communication with the noise generating subsystem 120, the Helmholtz resonator 110 having an active material responsive to the control signal 145 by adjusting a dimensional characteristic (L), (A) or (V) of the Helmholtz resonator 110 in such a manner as to affect a resonance characteristic (f) of the Helmholtz resonator 110. Wherein in response to the operational characteristic, the control signal 145 serves to affect the resonance characteristic (f) of the Helmholtz resonator 110 in such a manner as to reduce the noise propagating energy through the air intake duct 125 arising from the noise generating subsystem 120.

As discussed above, active materials capable of changing and/or actively controlling key dimensional aspects as well as stiffness of key elements of Helmholtz resonators contemplated herein include but are not limited to shape memory alloys (SMA's), shape memory polymers (SMP's), ferromagnetic shape memory alloys (FSMA's or MSMA's), magnetorheological elastomers, magnetostrictives (such as Terfenol D) in general, electrostrictives in general (such as piezoelectrics, piezoceramics in both bi-morph and unimorph form), electroactive polymers (EAP's), and magnetorheological (MR) and electrorheological (ER) fluids. A brief description of several examples of the functionality of each as well as an example of how and the form in which embodiments of the invention might be used to affect changes in the performance of Helmholtz resonators will now be discussed.

To Change Helmholtz Resonator Volume (V):

Shape Memory Alloys (SMA's) exhibit a modulus increase of 2.5 times and a dimensional recovery (shape memory) of up to 8% (depending on the amount of pre-strain) when heated above their Martensite to Austenite phase transition temperature. A downside is that while thermally activated shape recovery can occur in milliseconds, cooling times can be significantly longer resulting in complete thermal cycle times on the order of a fraction of a second to seconds depending on which portion of the activation cycle is involved. Thermally induced SMA phase changes are also one-way so that a biasing force return mechanism (such as a spring) would be required to return the SMA to its starting configuration once the applied field is removed. Joule heating can be used to make the entire system electronically controllable. Stress induced phase changes in SMA are however two-way by nature, where application of sufficient stress when an SMA is in its Austenitic phase will cause it to change to its lower modulus Martensitic phase in which it can exhibit up to 8% of "superelastic" deformation. Removal of the applied stress will cause the SMA to switch back to its Austenitic phase, in so doing recovering its starting shape and higher modulus.

To Change the Overall Volume (V) or to Change the Overall Length (L) or to Change the Orifice Opening Area (A):

FSMAs (also termed MSMA's) are a sub-class of SMAs. FSMAs can behave like conventional SMA materials that have a stress or thermally induced phase transformation between martensite and austenite. Additionally FSMAs are ferromagnetic and have strong magnetocrystalline anisotropy, which permit an external magnetic field to influence the orientation and/or fraction of field-aligned martensitic variants. When the magnetic field is removed, the material may exhibit complete two-way, partial two-way or one-way shape memory. For partial or one-way shape memory, an external stimulus, temperature, magnetic field or stress may permit the material to return to its starting state. Perfect two-way shape memory may be used for proportional control with continuous power supplied. One-way shape memory is most useful for dimension changing applications such as a change in the Helmholtz resonator volume or in the cross sectional size of the orifice opening by displacing and/or deforming a boundary wall. External magnetic fields are generally produced via soft-magnetic core electromagnets in automotive applications, though a pair of Helmholtz coils may also be used for fast response. To sum, Ferromagnetic SMA's exhibit rapid dimensional changes of up to several percent in response to (and proportional to the strength of) an applied magnetic field. Downsides are the fact that the changes are one-way changes and require the application of either a biasing force or a field reversal to return the ferromagnetic SMA to its starting configuration.

To Change the Overall Volume (V):

Shape Memory Polymers (SMP's) exhibit a dramatic drop in modulus when heated above the glass transition temperature of their constituent that has a lower glass transition temperature. Because this is a thermally activated property change and because they inherently have low values of thermal conductivity when used without fillers, they are not well-suited for rapid changes. If loading and/or deformation is maintained while the temperature is dropped, the deformed shape will be set in the SMP until it is reheated while under no-load, under which condition it will return to its as-molded shape. While SMP's could be used variously in block, sheet, slab, lattice, truss, fiber or foam forms, they do have a negative characteristic that they require continuous power to remain in their lower modulus state. Thus, SMP's are better suited for reversible shape setting of key dimensions, such as the Helmholtz resonator volume and the cross sectional dimensions of the one or more flow channels in a singular or perforated orifice opening.

To Change Volume (V):

Magnetostrictives are solids that develop a large mechanical deformation when subjected to an external magnetic field. This magnetostriction phenomenon is attributed to the rotations of small magnetic domains in the materials, which are randomly oriented when the material is not exposed to a magnetic field. The shape change is largest in ferromagnetic or ferrimagnetic solids. Terfenol-D is the most thoroughly explored form of magnetostrictive. Positive characteristics in terms of their use in Helmholtz resonator performance enhancement are their very fast response capability, the fact that strain is proportional to the strength of the applied magnetic field, and that they return to their starting dimension upon removal of the field. Negative characteristics are their very high cost, the fact that they are quite brittle, and that maximum strains are in the range from 0.1 to 0.2 percent.

To Change the Overall Neck Length (L):

Magnetorheological elastomers (MREs) consist of an elastomer matrix filled with magnetizable particles, typically sub-micron sized iron particles. They exhibit strong magnetoelastic coupling properties. The application of an external magnetic field stiffens the material due to the resultant alignment and shortening of the distance between the initially random magnetization vectors of the particles with this field. The same mechanism is responsible for the specimen's "magnetostriction", that is, a change in length (shortening) in the direction of an external magnetic field. In general, applying a magnetic field will cause a change in stiffness and potentially the shape of the MR elastomer. Stiffness and shape changes are proportional to the strength of the applied field and can be quite rapid if needed. Since the mechanical properties of MREs can be altered rapidly and reversibly, they are well suited for applications in which it is desirable to continuously and controllably vary the effective stiffness or dimensions such as those of the neck extension to the volume of the Helmholtz resonator under different operating conditions, such as rapid acceleration versus steady state driving for example. The challenge here relates to the packaging of the field generating coils.

To Change the Overall Area Size (A) of the Orifice Opening:

Piezoelectrics exhibit a small change in dimensions when subjected to an applied voltage. Their response is proportional to the strength of the applied field and is quite fast, being capable of easily reaching the thousand hertz range. Because their dimensional change is small (<0.1%), to dramatically increase the magnitude of dimensional change they are usually used in the form of piezo-ceramic uni-morph and bi-morph flat patch actuators that are constructed so as to bow into a concave or convex shape upon application of a relatively small voltage. The morphing and/or bowing of such patches within the liner of both the Helmholtz resonator cavity and inlet are eminently suitable for rapid changing of their effective cross sectional areas to the volume of the Helmholtz resonator.

To Change the Overall Area Size (A) of the Orifice Opening:

EAP's are essentially a laminate consisting of a pair of electrodes with an intermediate layer of low elastic modulus dielectric material. Applying a potential between the electrodes squeezes the intermediate layer causing it to expand in plane. They exhibit a response proportional to the applied field, and can be actuated at high frequencies. EAP morphing laminate sheets have been demonstrated, and again are eminently suitable for use directly as the bounding walls or as for example actuator tendons connected to the bounding walls to produce on-demand changes in the area of the orifice opening and/or volume of the resonator. A downside to EAP's is that they require applied voltages approximately three orders of magnitude greater than those required by piezoelectrics.

To Sense/Change Volume Flow:

MR fluids exhibit a shear strength that is proportional to the magnitude of an applied magnetic field. Property changes of several hundred percent can be affected within a few milliseconds, thus making them eminently suitable for cases such as stiffening and locking in the shape of boundary elements (consisting of a laminate with an internal MR film layer). An issue here, and downside of this approach compared to that of piezoelectrics and EAP's, is in terms of packaging of the coils necessary to generate the applied field. An example of how they might be used was also given previously.

To Sense/Change Volume Flow:

ER fluids are similar to MR fluids in that they exhibit a change in shear strength when subjected to an applied field, but with ER fluids, a voltage is applied rather than a magnetic field. Response is quick and proportional to the strength of the applied field. It is, however, an order of magnitude less than that of MR fluids and several thousand volts are typically required.

Based on physiology effects, the various aforementioned active materials can be used in the following ways to provide the target functionalities disclosed herein.

Thermally Activated Martensite to Austenite Phase Change in SMA:

An SMA insert, whether lattice, truss, hollow shell, porous, or otherwise is created such that it will fully fill the desired space when expanded to create the desired volume. An embodiment here would be the packaging and insertion of a Helmholtz resonator into an irregularly shaped space. The insert could either be itself the walls of the Helmholtz resonator cavity or could be an internal reinforcement or "rib" structure for an otherwise flexible wall structure. The SMA insert along with any accompanying flexible wall structure is then compressed and/or deformed when the SMA is in its lower temperature lower modulus Martensite state to smaller dimensions that will permit its insertion into the desired internal location and/or packaging space. The SMA insert could then be thermally activated, in so doing filling the desired interior space or desired portion thereof. This could be done passively, such as by the temperature of the location being above the Martensite to Austenite transition temperature, or through Joule heating.

In another class of embodiments the walls defining the orifice opening and/or volume of the resonator could be made of elastic material. SMA actuators could be attached externally to one or more of these walls and when actuated, the deflected wall will cause changes in variously the area, shape, and volume. De-activating the SMA actuators would cause the elastic walls to return to their original geometries through restretching of the SMA in its lower modulus Martensitic form. By using proportional control means such as digital pulse width modulation the walls could be deformed and held at intermediate positions/geometries allowing a wide ranging tuning capability.

Stress Activated Austenite to Martensite Phase Change in SMA:

An SMA insert in the Austenite state could be compressed, held compressed while inserted, then the holding force released to allow it to expand, in so doing filling the cavity and reverting back either partially or fully to Austenite state.

Thermally Activated Stiffness and Shape Changes in SMP:

An SMP insert, whether foam, lattice, truss, hollow shell, porous, or otherwise is created such that it will fully fill the desired space. It is then compressed and/or deformed when in its higher temperature soft state to smaller dimension that will permit its insertion into the desired internal location in a hollow structure. The SMP could either be cooled while held in this smaller dimension locking in this geometry or simply constrained in this smaller geometry. In the former case the SMP would then be inserted and reheated to allow it to slowly return to its original dimensions, or if smaller, to the interior dimensions of the hollow structure. In the latter case, once inserted, the compressing force would be removed from the SMP insert, which would then slowly return to its original dimensions, or if smaller, the interior dimensions of the hollow structure. The SMP would then be allowed to cool which would dramatically increase the stiffness and lock in the new shape of the SMP insert. If it were desired to remove the insert for some reason, or simply desired to dramatically lower its stiffness, the insert could be reheated.

FSMA's Field Activated Stiffness and Shape Changes:

From a practical standpoint, these are one-way effects unless the field can be reversed. To insert, the field can be applied, distorting the dimensions and allowing insertion. The field can then be removed. In another embodiment, insertion can be achieved while the material is in its softer more deformable state, and then the field can be applied to restore the shape. Application of the field in this second embodiment, once the insert is in place, could be used to rapidly change the stiffness of the insert if needed and/or desirable. The FSMA could also be used as an external actuator to the Helmholtz resonator cavity or neck to move or deform one or more of the walls, thus changing the volume of the cavity and/or cross section dimensions of the neck.

Magnetorheological Elastomers (MREs) Field Activated Stiffness and Shape Changes:

In general, these are two-way effects with the change in property, stiffness and/or dimension, being proportional to the strength of the applied field. The MRE could be used as either the wall itself or as an external actuator to the walls of the Helmholtz resonator cavity or neck to move or deform one or more of them, changing the volume of the cavity and/or cross section dimensions of the neck. Using them directly as the walls, the field activated stiffness change could also be used to actively damp specific and/or variable frequency content in the sound.

In embodiments in which the active materials are used as actuators to affect dimensional changes, contemplated herein are embodiment variants in which the active material based actuators are variously directly attached, in direct contact, and indirectly attached and/or in contact through an intermediate and/or linking device such as a cable.

If zero power-hold is desired in embodiments in which shape change is produced through actuation, in the case of those active materials which require continuous application of the activating field, then a latching mechanism needs to be included in the various proposed mechanisms, which is contemplated herein and considered within the scope of the invention disclosed herein.

To summarize, embodiments of the invention are intended to cover broadly the use of active materials to change, on command, and in some embodiments reversibly, the key dimensions of Helmholtz resonators, specifically the neck length and cross section including the number and/or dimensions of orifices and columnar tubes that may comprise the latter, and the walls of the Helmholtz volume, thereby affecting their performance in terms of noise reduction and/or sound quality alteration. Also covered is the large class of embodiments in which the active materials are to be used in altering, again reversibly if desired, the stiffness of the bounding surfaces forming the perimeter of the Helmholtz resonator in part or in whole including the neck, the orifice opening area and the resonator cavity volume.

Reference is now made to FIGS. 2-4, which depict alternative embodiments for changing the structural configuration of the Helmholtz resonator 110, thereby affecting the resonance characteristic of the Helmholtz resonator, all in accordance with embodiments of the invention.

Figure 2A:
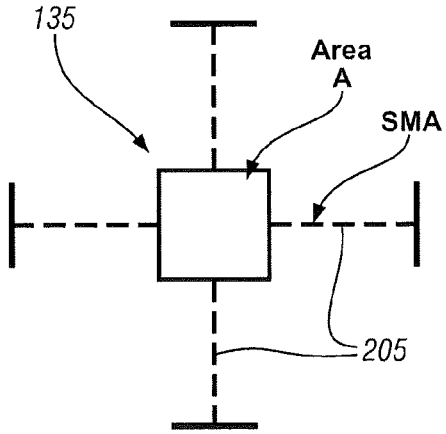
FIGS. 2A, 2B, 3A, 3B, 4A and 4B depict alternative embodiments for changing the structural configuration of a Helmholtz resonator in accordance with an embodiment of the invention.
Figure 2B:
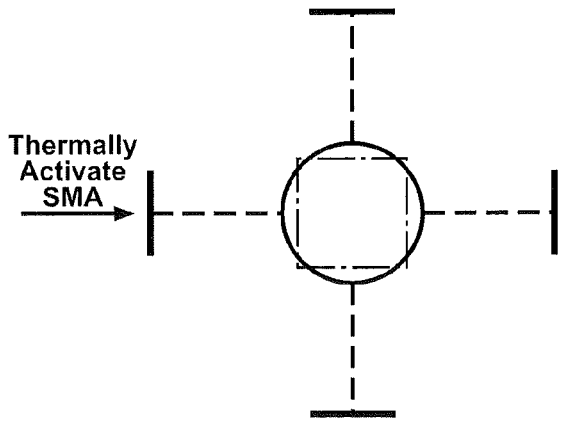

FIGS. 2A and 2B depict an end view of Helmholtz resonator 110 looking into the inlet orifice opening of neck 135, where area A in FIG. 2A has a rectangular cross-section when a plurality of actuators 205 formed of an SMA (depicted in dashed line fashion) connected to the neck 135 are in a thermally non-active state, and where area A in FIG. 2B has a circular cross-section when the actuators 205 are in a thermally active state. In the example depicted in FIGS. 2A and 2B, a thermally active state means that the SMA is in a contracted state in response to being heated. As such, the actuators 205 formed of SMA are capable of causing a reversible change in the shape and area of the inlet orifice opening of neck 135, which is made of a pliable material suitable for responding to the forces exerted upon it by the SMA, when switched from a non-active state to an active state, and vice versa.

Figure 3A:
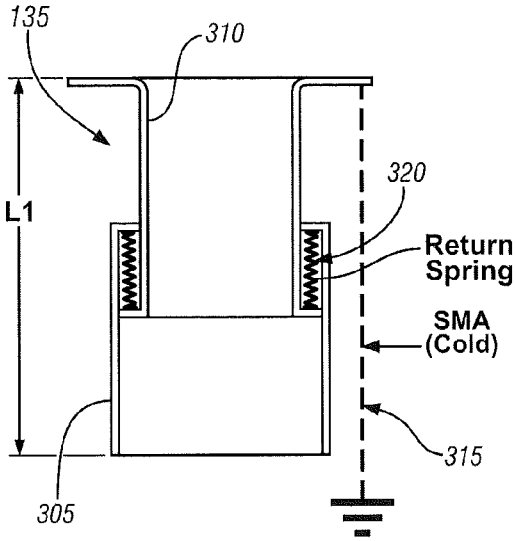
Figure 3B:
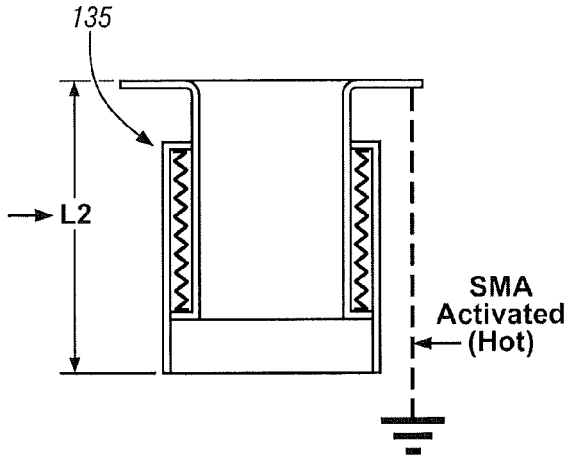

FIGS. 3A and 3B depict a cross-section side view of the neck 135 of Helmholtz resonator 110, which is formed having a first member 305, a second member 310 slidable relative to the first member 305, and an actuator 315 formed of an SMA (depicted in dashed line fashion) connected between the first and second members (or alternatively connected between the second member and a fixed reference). The length L of neck 135 has a first length L1 when the actuator 315 formed of SMA is in a thermally non-active state, as depicted in FIG. 3A, and has a second length L2<L1 when the actuator 315 is in a thermally active state. In the example depicted in FIGS. 3A and 3B, a thermally active state means that the SMA is in a contracted state in response to being heated. As such, the actuator 315 formed of SMA is capable of causing a reversible change in the length of neck 135 when switched from a non-active state to an active state, and vice versa. A return spring 320 is optionally employed to bias second sliding member 310 to the thermally non-active position of FIG. 3A.

Figure 4A:
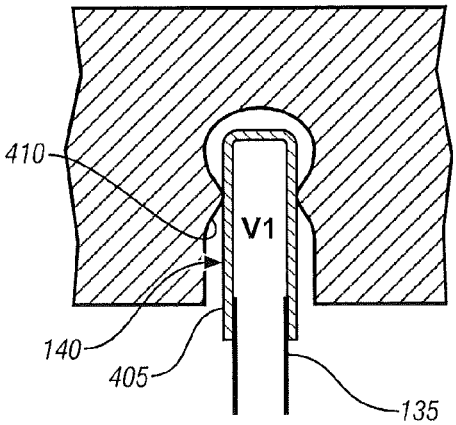
Figure 4B:
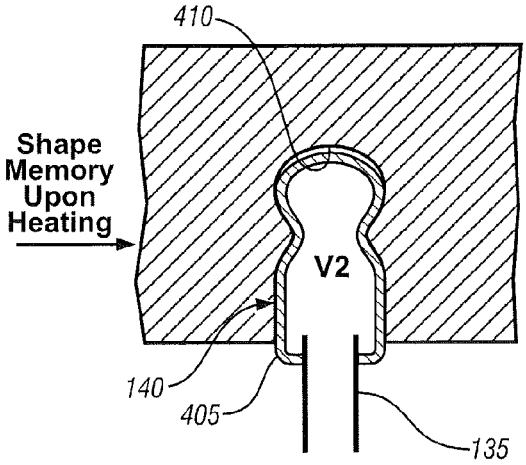

FIGS. 4A and 4B depict a cross-section side view of the resonance volume 140 of Helmholtz resonator 110 having walls 405 formed of an SMA and having a first shape and volume V1 when in a thermally non-active state, as depicted in FIG. 4A, and having a second shape and volume V2>V1 when in a thermally active state, as depicted in FIG. 4B. Here, a mold cavity 410 is provided with noise reduction system 105 for controlling the thermally active shape of walls 405. In the example depicted in FIGS. 4A and 4B, a thermally active state means that the SMA forming the walls 405 of volume 140 is in an expanded state in response to being heated. As such, the walls 405 formed of SMA, in conjunction with mold cavity 410, are capable of causing a reversible change in the volume 140 when switched from a non-active state to an active state, and vice versa. Alternatively the walls 405 may be formed of an SMP and having a first shape and volume V1 when in a thermally non-active state (for purposes of ease of insertion into the mold cavity 410), and when thermally activated recovering a second shape and volume V2>V1.

In view of the foregoing description of structure, it will be appreciated that appropriate control of such structure will provide methods for reducing noise in a device having a noise generating subsystem, embodiments of which will now be discussed with reference to the flowcharts depicted in FIGS. 5 and 6.

Figure 5:
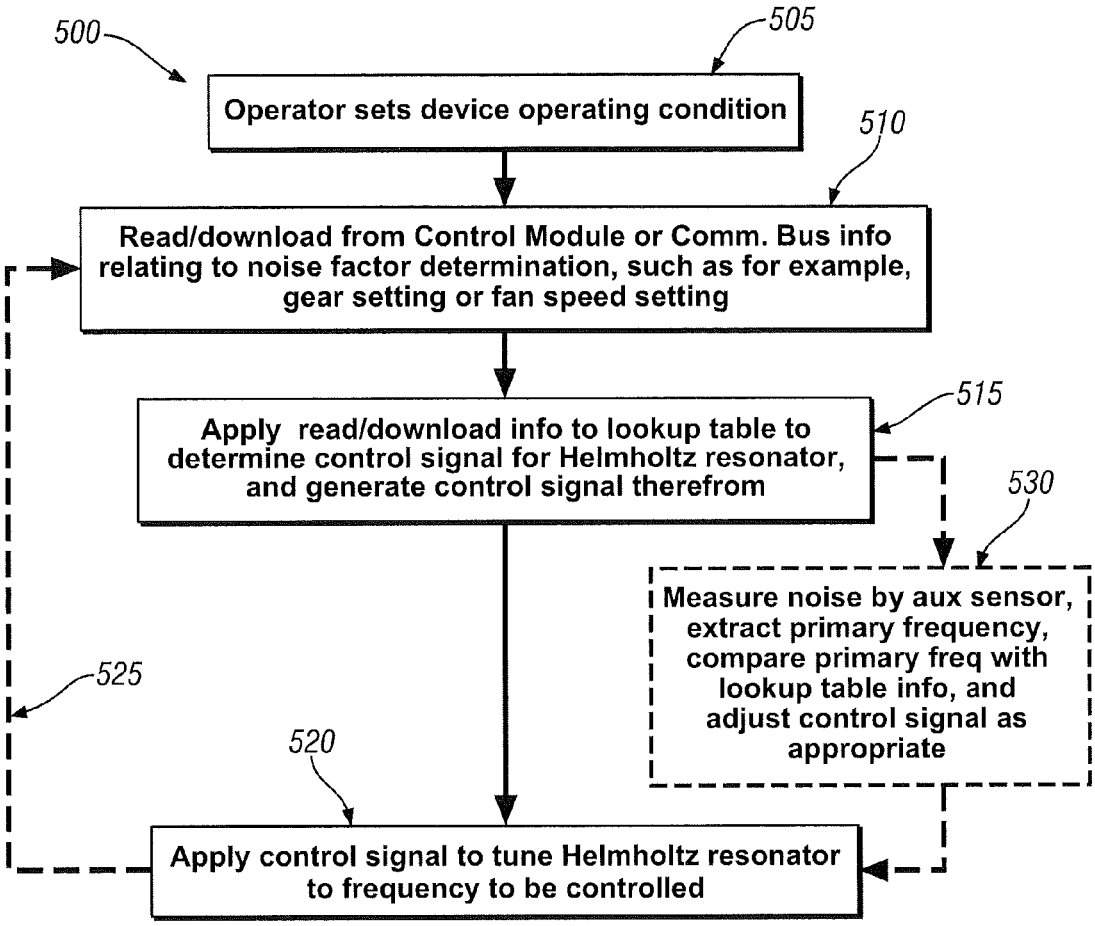
FIG. 5 depicts a flowchart of a method in accordance with an embodiment of the invention.

With reference to FIG. 5, a method 500 is depicted that begins at block 505 with an operator, such as a driver of an automobile for example, setting a device operating condition, such as setting a fan speed or shifting a gear in the automobile for example. With such a setting, the noise generating subsystem (air conditioning fan or vehicle transmission, for example) will inherently produce some noise dependent upon its operating condition. At block 510, information relating to noise factor determination, such as transmission gear setting or air conditioning fan speed setting for example, is read by the ECM 150 or from an associated communication Bus. At block 515, the controller 115 applies the information read by the ECM to a lookup table in memory 165 to determine and generate a control signal 145 for Helmholtz resonator 110, as discussed above. At block 520, the controller 115 applies the control signal 145 to tune the Helmholtz resonator 110 to the desired frequency to be controlled, thereby damping undesirable noise level at the harmonic frequencies. While no iteration of the above-noted method 500 may be necessary for effective noise damping, method 500 may include an optional iteration loop 525 to assure that the proper control signal has been applied to the Helmholtz resonator 110. At block 530, an optional path may be employed in method 500 that measures the noise under consideration by an auxiliary sensor 170, which provides such information to the controller 115 that in turn extracts information relating the primary frequency and compares the primary frequency with the lookup table information so that the control signal 145 can be adjusted as appropriate to fine tune the desired noise reduction.

Figure 6:
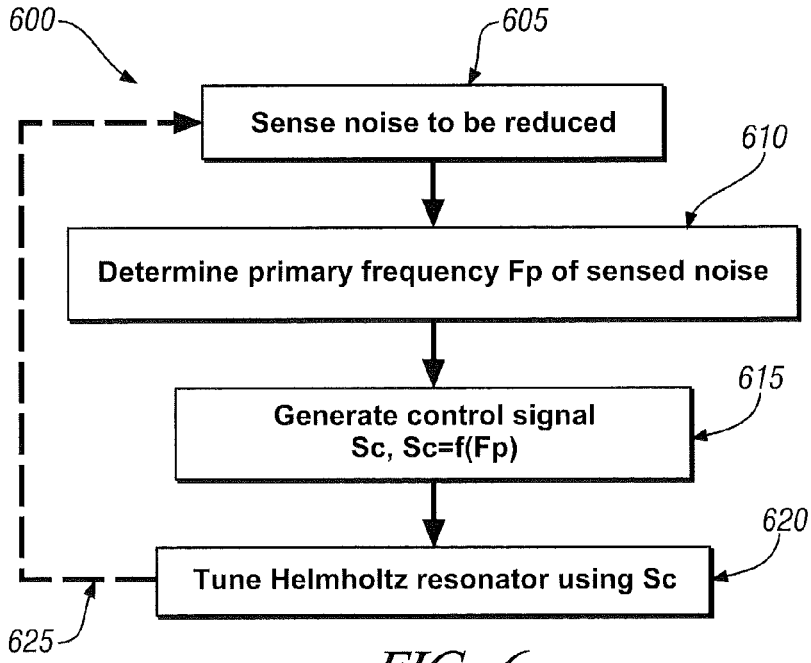
FIG. 6 depicts a flowchart of an alternative method to that of FIG. 2.

With reference now to FIG. 6, an alternative method 600 to that of method 500 may be employed where the noise to be reduced is sensed via ECM 150 or sensor 170, for example (block 605), and the primary frequency Fp of the sensed noise determined by the controller 115 (block 610). At block 615 controller 115 generates a control signal Sc=f(Fp), and at block 620 controller 115 uses the control signal Sc to tune the Helmholtz resonator 110 in a manner previously discussed. Optional iterative loop 625 may be employed to continuously adjust the frequency to which the Helmholtz resonator 110 should be tuned.

As discussed above, an embodiment of the invention may be embodied in the form of computer-implemented processes and apparatuses for practicing those processes. Embodiments of the invention may also be embodied in the form of a computer program product having computer program code containing instructions embodied in tangible media, such as floppy diskettes, CD-ROMs, hard drives, USB (universal serial bus) drives, or any other computer readable storage medium, such as read-only memory (ROM), random access memory (RAM), erasable-programmable read only memory (EPROM), and electrically erasable-programmable read only memory (EEPROM), for example, wherein, when the computer program code is loaded into and executed by a computer, the computer becomes an apparatus for practicing embodiments of the invention. Embodiments of the invention may also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein when the computer program code is loaded into and executed by a computer, the computer becomes an apparatus for practicing embodiments of the invention. When implemented on a general-purpose microprocessor, the computer program code segments configure the microprocessor to create specific logic circuits. A technical effect of the executable instructions is to reduce undesirable noise arising from a noise generating subsystem by tuning a Helmholtz resonator disposed in fluid communication with the noise generating subsystem.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A noise reduction system for a device comprising a noise generating subsystem, the noise reduction system comprising:

a Helmholtz resonator disposed in fluid communication with the noise generating subsystem, the Helmholtz resonator comprising a neck, and a resonance volume comprising a wall, at least one of the neck and the wall being formed from an active material responsive to a control signal that adjusts a dimensional characteristic of the Helmholtz resonator in such a manner as to affect a resonance characteristic of the Helmholtz resonator; and a controller responsive to an operational characteristic of either the device or the noise generating subsystem to produce the control signal;

wherein in response to the operational characteristic, the control signal serves to affect the resonance characteristic of the Helmholtz resonator in such a manner as to reduce a noise arising from the noise generating subsystem, or create a desirable sound quality alteration.

2. The noise reduction system of claim 1, wherein the device comprises an engine, and the operational characteristic comprises a speed of the engine.

3. The noise reduction system of claim 2, wherein the noise generating subsystem comprises an air intake duct in fluid communication with the engine.

4. The noise reduction system of claim 1, wherein the control signal serves to tune the Helmholtz resonator to a desired frequency, thereby damping inherent effects of noise level at harmonic frequencies.

5. The noise reduction system of claim 2, wherein the device comprises engine control module (ECM) comprising information associated with the speed of the engine.

6. The noise reduction system of claim 1, wherein:

the resonance characteristic of the Helmholtz resonator is defined by at least one of an intake orifice opening of the Helmholtz resonator, an intake neck length of the Helmholtz resonator, an intake cross-sectional area of the Helmholtz resonator, and a resonance volume of the Helmholtz resonator; and a dimensional characteristic of the Helmholtz resonator adjusted by the control signal comprises at least one of the intake orifice-opening of the Helmholtz resonator, the intake neck length of the Helmholtz resonator, the intake cross-sectional area of the Helmholtz resonator, and the resonance volume of the Helmholtz resonator.

7. The noise reduction system of claim 1, wherein:

the noise generating subsystem comprises an air conditioning subsystem comprising a blower and an air duct;

the operational characteristic comprises a speed of the blower; and the Helmholtz resonator is disposed in fluid communication with the air duct.

8. The noise reduction system of claim 1, wherein the controller comprises a sensor disposed responsive to a fluid pressure arising from the noise generating subsystem, and the operational characteristic is defined by the fluid pressure.

9. The noise reduction system of claim 1, wherein the controller comprises a processing circuit responsive to computer executable instructions which when executed on the processing circuit facilitates producing the control signal in response to the operational characteristic to affect the resonance characteristic of the Helmholtz resonator in such a manner as to reduce the noise arising from the noise generating subsystem.

10. The noise reduction system of claim 9, wherein:

the device comprises an engine;

the operational characteristic comprises a speed of the engine; and the controller comprises an electronic map or lookup table that defines a voltage of the control signal as a function of the speed of the engine.

11. The noise reduction system of claim 10, wherein:

the defined voltage of the control signal is productive of a dimensional change of the active material of the Helmholtz resonator that serves to tune the resonance characteristic of the Helmholtz resonator to a desired frequency, thereby damping inherent effects of noise level at the harmonic frequencies.

12. The noise reduction system of claim 10, wherein the processing circuit is further responsive to computer executable instructions which when executed on the processing circuit facilitates:

defining a tuning frequency of the Helmholtz resonator as a function of the speed of the engine;

defining a desired dimension of at least a portion of the Helmholtz resonator capable of being changed by application of the control signal to the active material, the desired dimension being a function of the tuning frequency; and defining the voltage of the control signal as a function of the desired dimension.

13. The noise reduction system of claim 1, wherein the active material comprises a shape memory alloy, a shape memory polymer, a ferromagnetic shape memory alloy, a magnetorheological elastomer, a magnetostrictive material, an electrorestrictive material, a piezoelectric material, piezoceramic material, an electroactive polymer, a magnetorheological fluid, or an electrorheological fluid.

14. The noise reduction system of claim 1, wherein the Helmholtz resonator comprises walls that define a resonator volume and an inlet neck having an inlet orifice opening, at least a portion of the walls being formed from an active material responsive to the control signal.

15. The noise reduction system of claim 1, further comprising an actuator comprising an active material responsive to the control signal, the actuator being coupled to at least a portion of the Helmholtz resonator to cause adjustment of a dimensional characteristic of the Helmholtz resonator in response to the control signal.

16. A method for reducing noise in a device comprising a noise generating subsystem, the method comprising:

in response to an operational characteristic of either the device or the noise generating subsystem, generating and sending a control signal to a Helmholtz resonator disposed in fluid communication with the noise generating subsystem, the Helmholtz resonator comprising a neck, and a resonance volume comprising a wall, at least one of the neck and the wall being formed from an active material responsive to the control signal by adjusting a dimensional characteristic of the Helmholtz resonator in such a manner as to affect a resonance characteristic of the Helmholtz resonator;

wherein in response to the operational characteristic, the control signal serves to affect the resonance characteristic of the Helmholtz resonator in such a manner as to reduce noise level arising from the noise generating subsystem.

17. A noise reduction system for a device comprising a kinetic energy generator coupled to a noise generating subsystem, the noise reduction system comprising:

a controller productive of a control signal;

a Helmholtz resonator disposed in fluid communication with the noise generating subsystem, the Helmholtz resonator comprising an active material responsive to the control signal that adjusts a dimensional characteristic of the Helmholtz resonator in such a manner as to affect a resonance characteristic of the Helmholtz resonator;

a first sensor disposed in signal communication with the noise generating subsystem of the device, and in signal communication with the controller, the first sensor being responsive to air pressure within the noise generating subsystem;

a second sensor disposed in signal communication with the kinetic energy generator, and in signal communication with the controller, the second sensor being responsive to an operational frequency of the kinetic energy generator including a primary frequency of the kinetic energy generator;

the controller being responsive to a signal from the first sensor and a signal from the second sensor to produce the control signal;

wherein the control signal serves to affect the resonance characteristic of the Helmholtz resonator in such a manner as to reduce a noise arising from the noise generating subsystem, or create a desirable sound quality alteration, the primary frequency of the kinetic energy generator being used by the controller to adjust the control signal to tune the desired noise reduction.

18. The noise reduction system of claim 17, wherein the controller comprises an electronic map or lookup table that defines a voltage of the control signal as a function of the primary frequency.

19. The noise reduction system of claims 18, wherein:

the Helmholtz resonator comprises a neck, and a resonance volume comprising a wall; and at least one of the neck and the wall are formed from the active material responsive to the control signal that adjusts a dimensional characteristic of the Helmholtz resonator in such a manner as to affect the resonance characteristic of the Helmholtz resonator.

* * * * *